United States Patent [19]

Subramanian et al.

[11] 4,046,851

[45] Sept. 6, 1977

[54] TWO STAGE SULFURIC ACID LEACHING OF SEA NODULES

[75] Inventors: Kohur Nagaraja Subramanian, Mississauga; Gerald Vernon Glaum, Oakville, both of Canada

[73] Assignee: The International Nickel Company, Inc., New York, N.Y.

[21] Appl. No.: 697,957

[22] Filed: June 21, 1976

[30] Foreign Application Priority Data

July 30, 1975 Canada ..... 232547

[51] Int. Cl.[2] ..... C01G 3/10; C01G 51/10; C01G 53/10

[52] U.S. Cl. ..... 423/41; 423/150

[58] Field of Search ..... 423/41, 150; 75/101 R, 75/115, 119

[56] References Cited

U.S. PATENT DOCUMENTS

| | | | |
|---|---|---|---|
| 2,872,306 | 2/1959 | Morrow | 75/101 R |
| 3,804,613 | 4/1974 | Zundel et al. | 423/150 |
| 3,809,549 | 5/1974 | Opratko et al. | 75/115 |
| 3,991,159 | 11/1976 | Queneau et al. | 423/150 |
| 4,008,076 | 2/1977 | Junghanss et al. | 75/119 |

OTHER PUBLICATIONS

Perry et al. *Chemical Engineering Handbook*, 4th Edition McGraw-Hill Book Company (1963) pp. 11-25, 11-26.

*Primary Examiner*—O. R. Vertiz
*Assistant Examiner*—Brian E. Hearn
*Attorney, Agent, or Firm*—Miriam W. Leff; Ewan C. MacQueen

[57] ABSTRACT

A process for extracting metal values from manganiferous sea nodules is provided in which nickel, copper, and cobalt values are selectively leached in a sulfuric acid medium in two stages, the first stage being effected at a temperature up to about 100° C and to a final pH of not less than about 1.5 and the second stage being effected at a temperature of about 160° C to about 260° C and at an initial pH of not less than about 1.5.

11 Claims, 1 Drawing Figure

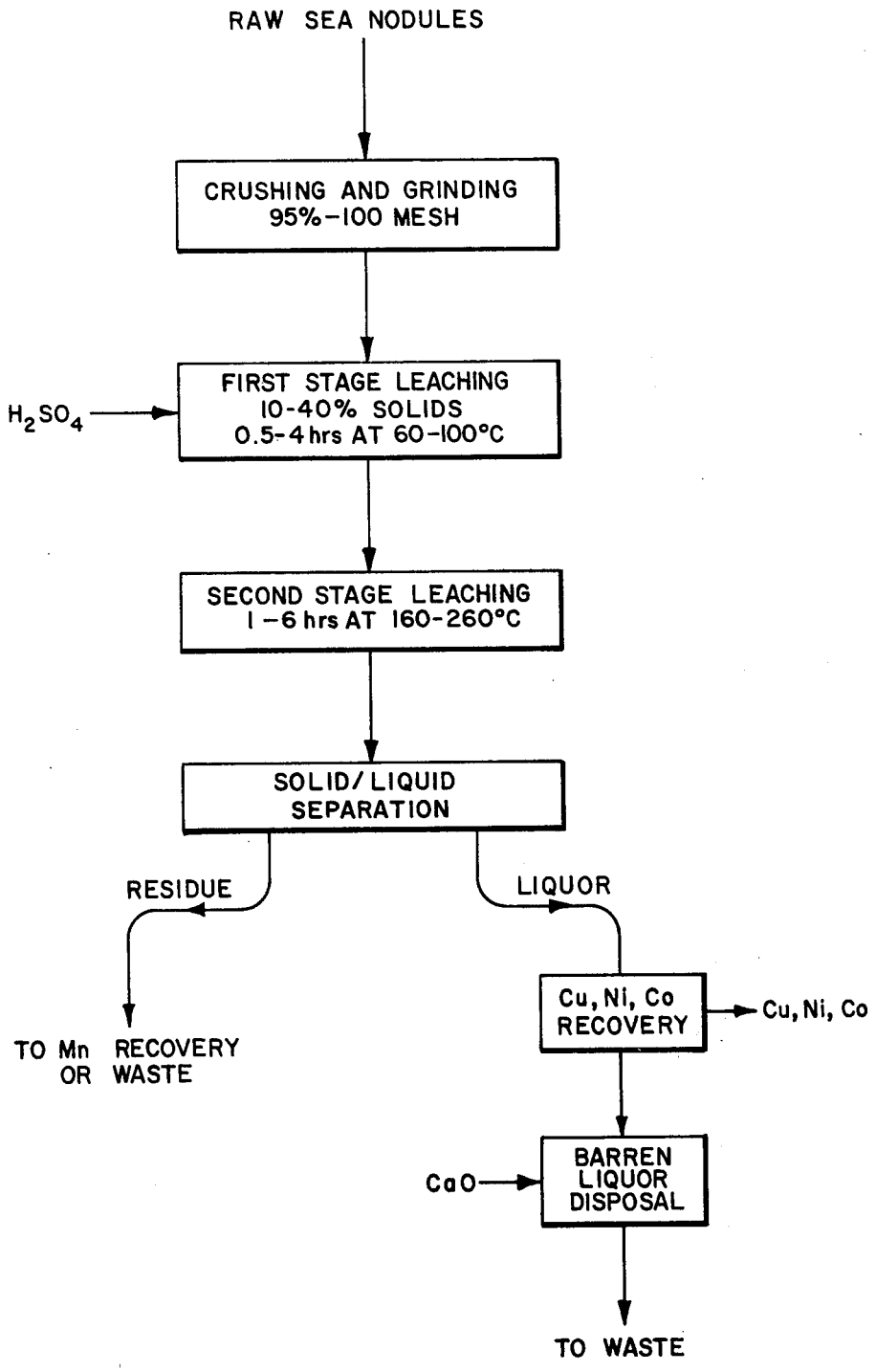
RAW SEA NODULES
CRUSHING AND GRINDING
95%-100 MESH
$H_2SO_4$
FIRST STAGE LEACHING
10-40% SOLIDS
0.5-4 hrs AT 60-100°C
SECOND STAGE LEACHING
1-6 hrs AT 160-260°C
SOLID/LIQUID
SEPARATION
RESIDUE
LIQUOR
TO Mn RECOVERY
OR WASTE
Cu, Ni, Co
RECOVERY
Cu, Ni, Co
CaO
BARREN
LIQUOR
DISPOSAL
TO WASTE

TWO STAGE SULFURIC ACID LEACHING OF SEA NODULES

This invention relates to a hydrometallurgical process for the extraction of nonferrous metal values from manganiferous sea nodules, and more particularly to a two-stage sulfuric acid leaching process for the selective extraction of nickel, cobalt and copper values from such nodules.

BACKGROUND OF THE INVENTION

Manganiferous sea nodules found in large quantities on the ocean floor are recognized to be a potentially valuable source of metals. The nodules contain substantial amounts of manganese and iron and a minor amount of nonferrous metals such as nickel, cobalt and copper. Typical deposits may contain up to about 2% nickel, up to about 2% copper, up to about 1% cobalt, up to about 25% iron and up to about 40% manganese, by weight (on a dry basis). The physical and chemical nature of the deposits vary depending on their location. However, since these components are tied in intimate and complex association, they are not amenable to separation by conventional low-cost physical beneficiation procedures. For the same reason extraction of these valuable metals is difficult.

Several methods have been proposed for extracting the metal values. The merits and disadvantages of a particular process depend on many factors in addition to the nature of the nodules, which may vary considerably with location of the deposits. For example, the availability and cost of fuel are major considerations. Selectivity, extent of extraction of desired metals, speed of reaction, availability and cost of reagents, reagent consumption, and equipment requirements are among other factors to be considered. Thus, alternative routes for extracting metal values permit the choice of a method which will give optimum recovery of the desired metals at a minimum cost in the light of variable pertinent factors.

Among the processes proposed for extracting metal values from sea nodules are those involving direct leach of the nodules with sulfuric acid. Leaching with sulfuric acid at ambient temperatures and pressures is a slow process in which acid consumption is high and the final extraction of valuable metals may be incomplete. To improve the dissolution of the valuable nonferrous metals, reducing agents which will dissolve the tetravalent manganese have been utilized in conjunction with an acidic leach. For example, U.S. Pat. No. 3,169,856, uses sulfur dioxide to reduce the tetravalent manganese and simultaneously dissolve nickel and copper values. Subsequently, the residue is releached to recover cobalt and any remaining nickel and copper values. Another process, U.S. Pat. No. 3,795,596 leaches the nodules with sulfuric acid to dissolve a portion of the copper and nickel and then releaches the residue with a ferrous sulfate or ferrous chloride solution to dissolve the manganese and the remaining valuable nonferrous metals. A major disadvantage of such reductive leach processes is that the resultant leach solutions contain the bulk of the manganese along with at least a portion of the valuable nonferrous metals and possible iron. Solution treatment schemes which require separating nickel, copper and cobalt from major amounts of manganese in solution before recovering or rejecting the manganese from solution are costly, and the overall cost of the process in comparison to the value of the products may be unattractive.

The use of a high temperature sulfuric acid leach for obtaining more rapid and complete extraction of the valuable nonferrous metals has been suggested. It has been found, for example, that at 450° F and 500 psig, nickel, copper, and cobalt can be rapidly extracted from sea nodules with lower acid consumption than required for the sulfuric acid leach at ambient conditions. Essentially, the same process has previously been applied to lateritic ores. In this process, nickel and cobalt are extracted from the lateritic ore by treatment with sulfuric acid in a steam agitated pachuca tank at 230° to 260° C and about 400 to 600 psig steam pressure. Published information on the operation of this process indicates that formation of massive sulfate scale deposits in the leaching vessels is a major problem. We have found that leaching sea nodules under similar conditions also results in formation of scale deposits. This will necessitate frequent shut down of the leaching vessels to remove the deposits, thus adding to labor costs, and so on.

One way to solve the scale deposit problem which we have found is to increase the agitation of the slurry during leaching. The power input to prevent scale formation by mechanical agitation, however, is undesirably high.

Large industrial processes are, of course, preferably operated continuously rather than by batch leaching. In high temperature, high pressure processes, special expensive pumps are required to feed the ore slurry to the leaching vessels. Pumping acidic slurries through such pumps may cause excessive corrosion and is avoided. Therefore, sulfuric acid is normally added to the hot ore slurry in the autoclave through a separate stream.

It has now been found that by subjecting the sea nodules to a two-stage leach in which the sea nodules are subjected initially to acid leaching under relatively mild conditions and then to leaching at high temperature and pressure, the valuable nonferrous metals such as nickel, cobalt and copper can then be extracted effectively under conditions which permit relatively rapid extraction with minimized scale formation. Furthermore, since most of the sulfuric acid is consumed during the first stage leach, corrosion during pumping the resultant slurry (pH preferably $\geqq 2$) to the high temperature, high pressure autoclave is minimized. During the low temperature leach some of the nickel and copper values as well as soluble gangue components are dissolved. However, it is the second high temperature leach that is relied on for high extraction of the copper, nickel and cobalt.

It is an object of the present invention to provide a method for treating manganese sea nodules to selectively extract nickel, copper, and cobalt, thereby avoiding complex solution treatment procedures for separating such values from manganese. Another object is to provide a method in which neither thermal pretreatment nor drying of the ore is required. A further object is to provide a hydrometallurgical method for treating sea nodules in which a sulfuric acid leach is carried out under conditions which will avoid the formation of massive basic sulfate scale deposits in the leaching vessel, but will not require a long period of time for suitable extraction nor an excessive consumption of acid.

These and other objects will become apparent from the following description taken in conjunction with the accompanying drawing.

THE DRAWING

The accompanying FIGURE is a schematic flow sheet showing a process for treating sea nodules to extract selectively nickel, cobalt and copper values according to a preferred embodiment of this invention.

THE INVENTION

In accordance with the present invention, manganiferous sea nodules containing acid soluble gangue minerals, a major amount of manganese and iron, and a minor amount of at least one of the nonferrous metal values nickel, cobalt and copper, are treated for the selective extraction of said nonferrous metal values in a two-stage sulfuric acid leaching process which comprises:

a. leaching raw sea nodules slurried in a sulfuric acid medium at an elevated temperature up to about 100° C, the acid being present in sufficient amount to dissolve at least a preponderant part of the acid soluble gangue minerals and to obtain a final pH of no less than about 1.5, and b. releaching the resultant nodules at a temperature higher than about 100° up to about 260° C at an initial pH not less than about 1.5 to extract nickel, cobalt and copper from said nodules.

In a preferred embodiment of the present invention the second leach is carried out directly in the product leach solution of the first stage, e.g. by raising the temperature of the resultant slurry. During the first leach at least a part of the nickel, cobalt and copper values present in the nodules will dissolve in the first leach solution, and the second leach is carried out to extract additional nickel, cobalt and copper into the leach solution. Thus, the total amount of the extracted nickel, cobalt and copper will be present and can be recovered from the final leach solution.

As indicated above, the composition of sea nodules varies depending on location. However, generally the nodules may contain about 10 to about 50% by weight (on a dry basis) of a gangue fraction which consists mainly of several clay minerals such as montmorilonite, illite, kaolinite, calcium carbonate, silica diatoms, and zeolites. The reactions which take place in the course of acid leaching of sea nodules are many and complex and will vary greatly with the conditions imposed. Although the present invention is not dependent on any one theory, it is believed that uncontrolled dissolution of the acid soluble gangue content of the nodules in the presence of strongly acidic solution is a major contributory factor in the formation of scale deposits at high temperatures. It is further believed that the uncontrolled extraction of aluminum and iron at high temperatures in the presence of alkali metal sulfates and sulfuric acid will cause the precipitation of basic metal sulfates, e.g. basic aluminum sulfates, which will form scale on the walls of the vessel. By permitting dissolution of the acid soluble gangue minerals to consume most of the free sulfuric acid at relatively mild conditions in the first leach stage, the present process avoids the deposition of scale in the reactor during the second stage leach.

Thus, the first leach stage is conducted under conditions to avoid scale formation, and preferably, maximize consumption of free sulfuric acid. In general, it has been found that acid soluble gangue constituents of the nodules will dissolve at temperatures up to about 100° C without the formation of scale. Below about 60° C, dissolution is too slow. Preferably, the first leach is conducted at a temperature in the range of about 60° C to about 90° C. The relatively low temperature first stage leach is preferably carried out at atmospheric pressure, although higher pressures can be used. Leaching is preferably conducted for a period of time sufficient to consume substantially all of the free sulfuric acid by dissolution of the acid soluble gangue constituents of the nodules. In general, the first leach stage is conducted for a period of about 0.5 to about 4 hours.

During the first stage leach sufficient acid is added to dissolve all the nickel, cobalt and copper present in the ore. Since the acid soluble gangue minerals also dissolve, and usually more readily than the valuable nonferrous metals, sufficient acid must also be present over and above the gangue minerals. The amount of acid required can be determined readily empirically as to allow for variations in ores. In general, however, it has been found that for a feed to the first stage containing about 10% to 40% solids, a sulfuric acid content of about 20 to 50%, based on the weight of the nodules is suitable.

A key feature of the present process is the control of the acid content so that in the second stage the initial pH is no lower than about 1.5, and preferably it is at least about 2. At an initial pH lower than about 1.5 at the higher temperatures, i.e. greater than 100° C, scale will form; and at a final pH lower than about 1 at such temperatures there is also a danger of scale formation.

The purpose of the higher temperatures in the second stage leach is to maximize the extraction of the valuable nonferrous metals such as nickel, cobalt and copper, and the nodules are permitted to remain at reaction temperature to achieve this extraction. In general, at a temperature of about 180° C to about 200° C, substantially all the remaining nickel, cobalt and copper will be extracted in about 1 to about 6 hours.

Normally, the power requirement for agitation of a slurry during leaching depends on physical factors such as the shape and size of the leaching vessel, the particle size of the of the solids, and the density of the slurry. We have found that the power requirement for agitation to minimize scale formation during direct single stage high temperature sulfuric acid leaching of sea nodules is considerably in excess of the normal requirement. However, the power requirement for agitation to minimize scale formation during the second stage high temperature leach of this invention is much lower, and more typical of the requirement for adequate suspension of a slurry with the same pulp density and solids particle size. Typically, the power for agitation is applied at a rate of 0.5 to 5, preferably 0.5 to 1.5 kilowatts per cubic meter ($kW/m^3$) to minimize scale formation.

Preferably, the pulp density in the second stage is about 20 to 40% solids and the reactants are maintained at a temperature of above 100° C, typically in the range of about 160° to about 260° C. Advantageously, the temperature is maintained above about 160° C for a suitable reaction rate. Preferably, the second stage is carried out at a temperature in the range of about 180° C to about 200° C.

At a temperature of about 160° to 260° C the steam pressure is about 90 to 660 psig. Initially the pH of the second stage leach is greater than about 1.5 and preferably it is about 2. The final pH is preferably greater than about 1, preferably about 1.5 or 2.

Nickel, cobalt and copper can be recovered from the leach solution. Most of the iron and manganese values will remain in the leach residue. The leach residue can be treated to recover the manganese and/or iron. Known techniques can be used for recovery of the metal values from the solution and residue.

Referring to the drawing, raw sea nodules are subjected directly to an initial (stage I) acidic leach under relatively mild conditions. Prior to the initial leaching step, it is advantageous to reduce the particle size of the nodules. Accordingly, the nodules are crushed, ground or otherwise reduced to a fine particle size, e.g. 95% less than about 4 mesh (TSS), and preferably 95% less than about 100 mesh. Although the nodules are porous and have a relatively large surface area, the great tortuosity of the pores in the nodules hinders the diffusion of reactants and products. Therefore, it is advantageous to reduce the size of the nodules, thereby making them receptive to complete and rapid reactions.

In the embodiment shown in the accompanying FIGURE, the wet raw nodules are ground to 95% ≦100 mesh (TSS), and the ground nodules are mixed with water to form a slurry containing about 10% to 40% solids. In stage I, $H_2SO_4$ is added to the slurry in an amount of 20% to 50% $H_2SO_4$ by weight of the nodules. This will provide an initial pH of up to about 0.7. The temperature of the sulfuric acid containing slurry is raised to 60° to 100° C, e.g. 90° C, and maintained at temperature for 0.5 to 4 hours. In stage II, the resultant slurry is maintained at 160° C to 260° C, e.g. about 180°, for 1 to 6 hours.

Thereafter the leach residue is separated from the leach solution, e.g. by filtration. As indicated above, nickel, cobalt and copper can be recovered by known techniques. For example, copper can be extracted from solution by solvent extraction, stripped from the solvent with spent electrolyte, and then recovered from the electrolyte by electrolysis. Nickel, cobalt and any copper remaining can be precipitated, e.g. with $H_2S$. The nickel and cobalt can be recovered from the precipitate by known methods. For example, the precipitate can be redissolved and cobalt extracted selectively by solvent extraction. The nickel and cobalt can then be recovered by electrolysis.

The leach residue can be treated for manganese recovery, e.g. by roasting to eliminate sulfur in the form of sulfate which has precipitated during leaching, then reduction and smelting to produce ferromanganese.

The following illustrative examples are given for the purpose of enabling those skilled in the art to have a better understanding of the invention.

In the tests sea nodules are used which contain, by weight, on a dry basis, approximately 0.79% copper, 1.02% nickel, 0.21% cobalt, 7.38% iron and 22.4% manganese. The raw nodules are ground wet to pass a 100 mesh (TSS). Size analysis of the ground nodules follows:

| Size | +150 | +105 | +75 | +46 | +35 | +24 | +16 | +12 | (microns) |
|---|---|---|---|---|---|---|---|---|---|
| wt. | 1.4 | 7.6 | 20.1 | 25.2 | 38.9 | 51.2 | 60 | 64.3 | (%) |

EXAMPLE 1

This example shows the extent of scale formation as a function of agitation during a conventional single stage sulfuric acid leach of sea nodules at high temperature.

In a series of three tests, the wet ground raw sea nodules are slurried in water to provide a pulp density of about 30% solids. After raising the temperature to 180° C the slurries are agitated at 600, 400, and 200 revolutions per minute, respectively, 40% $H_2SO_4$ by weight of nodules is injected and the reaction is permitted to proceed for 3 hours. Thereafter the percent copper and nickel extracted into the leach solution and weight of copper, nickel and sulfate in the scale are determined. The results are tabulated in Table I.

The results show that the copper and nickel extraction is a function of the agitation and that considerable power is required to extract 86% and 95% nickel and that even when 600 revolutions per minute agitation is employed scale deposits are formed. At 200 revolutions per minute the nickel and copper recovered in solution is rather low, viz. 57% and 61% respectively, and the amount of scale and copper and nickel in the scale is relatively high.

TABLE 1

Single Stage Sulfuric Acid Leaching of Sea Nodules
Scale Formation as a Function of Agitation Leaching: 40% $H_2SO_4$ by weight of nodules injected at 180° C
30% solids, 3 hrs. at 180° C.

| | Agitation | | Extraction | | Scale Loss | | | |
|---|---|---|---|---|---|---|---|---|
| Test | Rate rev/min | Power kW/m³ | Cu % (1) | Ni % (1) | weight % (2) | Cu % (3) | Ni % (3) | $SO_4$ % (3) |
| A | 600 | 1.4 | 86 | 95 | 1.7 | 2.5 | 3.4 | 1.6 |
| B | 400 | 0.6 | 82 | 87 | 4.7 | 7.8 | 9.9 | 5.5 |
| C | 200 | .05 | 61 | 57 | 20 | 33 | 41 | 22 |

(1) Percent metal values reporting in solution based on metal values in the feed.
(2) Total weight percent scale based on weight of nodules.
(3) Percent values in scale based on metal values in feed.

EXAMPLE 2

This example illustrates the first stage leach at low temperature in accordance with present invention.

The feed to the first stage leach is essentially the same as the feed provided to the tests of Example 1. In this example, however, the temperature of the feed is raised to only 90° C prior to addition of 40% $H_2SO_4$ by weight of nodules and it is maintained at 90° C for 1 hour. The final pH of the first stage leach slurry is 2.

The data tabulated in Table II show 61% extraction of copper and 67% nickel extracted at low temperature. No scale formation was observed.

TABLE II

First Stage Sulfuric Acid Leaching of Sea Nodules

Leaching: 40% $H_2SO_4$ by weight of Nodules
30% solids, 1 hr. at 90° C.

| | | | Residue Analyses | | | Extractions | |
|---|---|---|---|---|---|---|---|
| Test | Time (hr) | pH | Cu | Ni % | $SO_4$ | Cu % (1) | Ni % (1) |
| D | 1.0 | 2.0 | 0.38 | 0.45 | 3.2 | 61 | 67 |

(1) Percent metal values reporting in solution, based on values in feed.

EXAMPLE 3

This example illustrates the extent of scale formation as a function of agitation during the second stage sulfuric acid high temperature leach in accordance with this invention.

In a series of three tests, the wet ground raw sea nodules are slurried in a sulfuric acid solution to provide a pulp density of 30% solids. After maintaining the slurry at 90° C for 1 hour, the temperature is raised to and maintained at 180° C for 3 hours. During the second stage leach at 180° C, the slurry is agitated at either 200, 400 or 600 revolutions per minute. The power requirements for agitating the slurry (in kilowatts per cubic meter) and the analyses of the leach solutions and scale losses are tabulated in Table III.

The results show that even at 200 revolutions per minute (Test G) relatively high nickel, copper and cobalt extraction is obtained. At 400 revolutions per minute the copper and nickel extraction is essentially maximized and there is substantially no scale formation. The results also show that the process is selective for cobalt, nickel and copper extraction; the iron and manganese contents of the solution being very low.

TABLE III

Two Stage Sulfuric Acid Leaching of Sea Nodules
Scale Formation as a Function of Agitation Leaching: Stage 1: 40% $H_2SO_4$ by weight of nodules
30% solids, 1 hr. at 90° C.
Stage 2: 3 hr. at 180° C.

| | Agitation | | Extraction | | | | | | Scale Loss | | | |
|---|---|---|---|---|---|---|---|---|---|---|---|---|
| Test | Rate rev/min | Power kW/m³ | Cu | Ni | Co % (1) | Fe | Mn | Wt. (2) | Cu | Ni % (3) | $SO_4$ |
| E | 600 | 1.4 | 87 | 95 | 80 | 2.5 | 5.2 | N.D. | — | — | — |
| F | 400 | 0.6 | 87 | 96 | 74 | 2.2 | 3.3 | N.D. | — | — | — |
| G | 200 | <.05 | 79 | 89 | 69 | 2.6 | 3.2 | 6.0 | 9.6 | 7.5 | 4.5 |

N.D. — Not Detected
(1) Percent metal values reporting in solution, based on weight in the feed.
(2) Total Weight Percent scale loss based on the weight of the nodules.
(3) Percent values in scale, based on metal values in feed.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A two-stage process for treating manganiferous sea nodules containing acid soluble gangue minerals, a major amount of manganese and iron, and a minor amount of at least one of the nonferrous metals nickel, cobalt, and copper, for the selective extraction of said nonferrous metal values comprising:

a. effecting a first stage leach of raw sea nodules slurried in a sulfuric acid medium at an elevated temperature up to about 100° C, said slurry having a pulp density of about 10% to 40% solids and having a sulfuric acid content of about 20% to 50% based on the weight of the nodules, the acid being present in sufficient amount to dissolve a preponderant part of the acid soluble gangue minerals and to obtain a resultant slurry having a final pH of no less than about 1.5, and b. effecting a second stage leach of the resultant nodules of the first stage leach in the resultant leach solution of the first stage leach at a temperature in the range of above about 100° C up to about 260° C at an initial pH no lower than about 1.5 to extract nickel, cobalt and copper from said nodules; whereby said nickel, cobalt and copper values are extracted from said nodules with reduced tendency for scale formation.

2. A two-stage process for treating manganiferous sea nodules as defined in claim 1, wherein the second stage leach is carried out directly in the product leach solution of the first stage leach.

3. A two-stage process for treating manganiferous sea nodules as defined in claim 1, wherein the first stage leach is effected for a period of time sufficient to dissolve substantially all the acid soluble gangue minerals in the acid medium.

4. A two-stage process for treating manganiferous sea nodules as defined in claim 1, wherein the final pH of the first leach slurry is about 2.

5. A two-stage process for treating manganiferous sea nodules as defined in claim 1, wherein the first stage leach is carried out at a temperature in the range of about 60° C to about 90° C.

6. A two-stage process for treating manganiferous sea nodules as defined in claim 1, wherein the second stage leach is carried out at a temperature in the range of about 180° C to about 200° C.

7. A two-stage process for treating manganiferous sea nodules as defined in claim 1, wherein the second stage leach is carried out with an initial pH of about 2.

8. A two-stage process for treating manganiferous sea nodules as defined in claim 1, wherein the second stage leach is carried out for a sufficient period of time to maximize extraction of the nickel, cobalt and copper.

9. A two-stage process for treating manganiferous sea nodules as defined in claim 1, wherein the second stage leach is carried out with power for agitation applied at a rate of about 0.5 to 1.5 kW/m³ to minimize scale formation.

10. A two-stage process for treating manganiferous sea nodules as defined in claim 9, wherein the pulp density of the first stage leach is about 20% to 40% solids and the resultant leach is carried out directly in the product of the first stage leach.

11. A two-stage process for treating manganiferous sea nodules containing acid soluble gangue minerals, a major amount of manganese and iron, and a minor amount of at least one of the nonferrous metal values nickel, cobalt and copper for the selective extraction of nonferrous metal values, comprising:

a. effecting a first stage leach of raw sea nodules in a sulfuric acid medium at an elevated temperature up to about 100° C, said slurry having a pulp density of about 10% to 40% solids and having a sulfuric acid content of about 20% to 50% based on the weight of the nodules, the acid being present in sufficient amount to dissolve substantially all of the acid soluble gangue minerals and to obtain a slurry having a final pH of no less than about 1.5, a portion of the nickel, cobalt and copper values being extracted into said first stage leach solution, and b. effecting a second stage leach of the resultant nodules directly in the product of the first stage leach at a temperature in the range of about 160° C to about 260° C and at an initial pH of no less than about 1.5 for a period of time sufficient to maximize extraction of the nickel, cobalt and copper in the second leach solution; whereby said nickel, cobalt and copper values are extracted from said nodules with reduced tendency for scale formation.

* * * * *